United States Patent [19]

Nielsen

[11] Patent Number: 4,464,213

[45] Date of Patent: Aug. 7, 1984

[54] NOBLEIZATION OF BETA BRASS

[76] Inventor: John P. Nielsen, One Washington Square Village, New York, N.Y. 10012

[21] Appl. No.: 429,703

[22] Filed: Sep. 30, 1982

[51] Int. Cl.[3] ..... C22C 9/04; C22C 30/02

[52] U.S. Cl. ..... 148/442; 420/464; 420/483; 420/587

[58] Field of Search ..... 420/477, 464, 504, 507, 420/508, 497, 483, 587; 148/434, 430, 442, 413

[56] References Cited

U.S. PATENT DOCUMENTS

| | | | |
|---|---|---|---|
| 1,580,444 | 4/1926 | Shields | 420/507 |
| 2,200,050 | 5/1940 | Auwärter | 420/587 |
| 2,248,100 | 7/1941 | Loebich | 420/587 |

FOREIGN PATENT DOCUMENTS

| | | | |
|---|---|---|---|
| 618100 | 2/1949 | United Kingdom | 420/477 |

OTHER PUBLICATIONS

Alloys Index, "Cu–48Zn–15 Au", vol. 8, 1981, published by Metals Information, Metals Park, Ohio 1982, p. E–244.

*Primary Examiner*—Peter K. Skiff
*Attorney, Agent, or Firm*—E. Janet Berry

[57] ABSTRACT

The retention of the beta brass phase structure (body-centered cubic) as gold atoms (molars) are substituted for copper atoms. Thus essentially the useful physical and working properties of the beta brasses are retained (hot forgeability, castability, some ductility etc.). As to chemical behavior, there is a definite nobleization effect of the beta brasses, i.e. all gold-containing beta golds are more tarnish resistant than the beta brasses, and the nobleization increases with gold content. However, of most importance from a commercial point of view, is that the low kt beta golds (4-kt, 6-kt) are more tarnish resistant than the 10-kt conventional jewelry alloys, and equal to those of 14-kt gold. In essence there is a tarnish resistance enhancement in going from alpha structure to beta structure kt for kt, in the jewelry range. Other noble metals (Pd, Pt, Ru, Rh, Os, Ir and Ag) may be used singly or in combinations with, or in lieu of, the gold.

3 Claims, 2 Drawing Figures

13 Beta gold 6 kt
(.25 Au, .335 Cu,.415 Zn)
Microstructure 100X after
48 hr. tarnish test 14 Conventional jewelry gold - 10 kt
(.417 Au, .408 Cu, .117 Ag, .058 Zn)
Microstructure 100X after
48 hr. tarnish test

NOBLEIZATION OF BETA BRASS

The customary brasses are alloys of Cu-Zn, ranging from 5% to 35% Zn by weight, essentially single phase, the so-called alpha structure. The alpha structure in the brasses refers to the terminal phase, face-centered cubic copper in the Cu-Zn phase diagram.

There is a second type of commercial brasses with higher Zn content, 39–40% by weight, also essentially single phase, but with the body-centered cubic structure, known as the beta brasses. (Commercial names are manganese bronze, naval brass, and Muntz metal). The beta brasses are less ductile than the alpha types and generally must be hot worked or cast in order to be fabricated into useful articles. What is interesting is that in spite of the lower copper content (a less active element than zinc) the beta alloys have rather good corrosion resistance, relative to the alpha alloys, in sulfide-forming environments (sodium sulfide solutions, hydrogen sulfide gas, and the like). Thus the beta brasses are commercially useful for marine hardware, heat exchange tubing, and architectural panel sheets. Indeed, there is even a dental prosthesis alloy of this type, since it is the sulfide in food that tarnishes metal dental prostheses.

The object of this invention is to improve the beta type brasses by substituting gold for copper strictly on an atom for atom (i.e. replacement of a copper atom for a gold atom), content basis thus retaining the beta phase structure. This is possible since there is a similarity in phase diagrams between the Cu-Zn and the Au-Zn systems. Thus a series of ternary alloys can readily be formed with compositions indicated by the X and Y fractions in the formula: $Au_X$-$Cu_Y$-Zn, the $X+Y=0.5$ atoms. (There is a small latitude in the 0.5 atoms level in that the phase diagram shows several percent width in the beta phase region at room temperature).

In the making of these alloys by melting, as a typical example, Au, Cu, and Zn together, the weight percent compositions are as follows:

| 0 kt | 2 kt | 4 kt | 6 kt | 8 kt | 10 kt | 12 kt | 14 kt | 16 kt | 18 kt |
|---|---|---|---|---|---|---|---|---|---|
| Au | | | | | | | | | |
| 0.00 | 8.33 | 16.70 | 25.00 | 33.30 | 41.70 | 50.00 | 58.30 | 66.70 | 75.00 |
| Cu | | | | | | | | | |
| 49.50 | 43.90 | 38.40 | 33.50 | 27.50 | 22.00 | 16.50 | 11.00 | 5.50 | 0.10 |
| Zn | | | | | | | | | |
| 50.50 | 47.80 | 44.90 | 41.50 | 39.20 | 36.30 | 33.50 | 30.70 | 27.80 | 24.90 |
| All | | | | | 100.00 | | | | |

It is to be noted that while the weight percent of Zn decreases with increasing kt content of the gold, the atomic percent is precisely 50% throughout the series. It is not possible to go beyond 75% by weight Au because all the copper atoms for substitution have been exhausted. In other words a 75% by weight gold, 25% Zn alloy is a 50–50 atom percent content alloy, and is precisely a beta phase alloy.

An alloy series was prepared with compositions as shown in the following table:

| CHEMICAL ANALYSIS OF BETA GOLDS | | | | | |
|---|---|---|---|---|---|
| | Karat | % Cu | % Zn | % Au | Treatment |
| 1. | 2 | 49.64 | 47.54 | 2.82 | Air cooled & Homogenized |

-continued

| CHEMICAL ANALYSIS OF BETA GOLDS | | | | | |
|---|---|---|---|---|---|
| | Karat | % Cu | % Zn | % Au | Treatment |
| 2. | 2 | 49.89 | 47.48 | 2.63 | Air cooled |
| 3. | 4 | 40.11 | 47.65 | 12.24 | Water quenched |
| 4. | 4 | 40.32 | 46.87 | 12.81 | Air cooled |
| 5. | 4 | 33.53 | 38.14 | 28.33 | Air cooled & Homogenized |
| 6. | 6 | 33.69 | 43.58 | 22.73 | Water quenched |
| 7. | 6 | 34.49 | 46.23 | 19.28 | Air cooled and Homogenized |
| 8. | 6 | 33.79 | 46.21 | 20.00 | Air cooled |
| 9. | 8 | 28.84 | 36.78 | 34.38 | Air cooled |
| 10. | 8 | 28.25 | 37.15 | 34.60 | Air cooled & Homogenized |
| 11. | 8 | 27.08 | 39.28 | 33.64 | Water quenched |
| 12. | 10 | 21.57 | 35.25 | 43.18 | Water quenched |
| 13. | 10 | 18.60 | 40.71 | 40.69 | Air cooled |
| 13a. | 10 (repeat) | 20.00 | 47.01 | 32.99 | Air cooled |
| 14. | 12 | 11.40 | 36.68 | 51.92 | Air cooled |
| 14a. | 12 (repeat | 11.13 | 38.59 | 50.28 | Air cooled |
| 15. | 12 | 11.43 | 29.76 | 58.81 | Water quenched |
| 16. | 14 | 11.48 | 30.35 | 58.17 | Water quenched |
| 17. | 14 | 10.92 | 30.09 | 58.99 | Air cooled |
| 18. | 16 | 6.13 | 26.54 | 67.33 | Water quenched |

Note:
1. The copper and zinc values were determined by measurements with the polarograph.
2. The gold value is determined by difference.

The alloys were prepared by melting the appropriate charges of metals in quartz capsules (to avoid zinc loss) and small coupons of the alloy were tested for tarnish resistance in sodium-sulfide solution. For the type of tarnish test used, see Tuccillo and Nielsen, "Observations of Onset of Sulfide Tarnish on Gold-base alloys," J. Prosthetic Dentistry, 25, 629–637 (1971). The results showed a marked increase in tarnish resistance over ordinary beta brass, with the tarnish resistance increasing steadily with increase in gold substitution.

An especially unexpected finding was that in comparing the tarnish resistance with jewelry gold alloys, kt for kt, the beta alloys were distinctly superior to these alloys.

In the attached sheet of drawings.

Figure 1A:
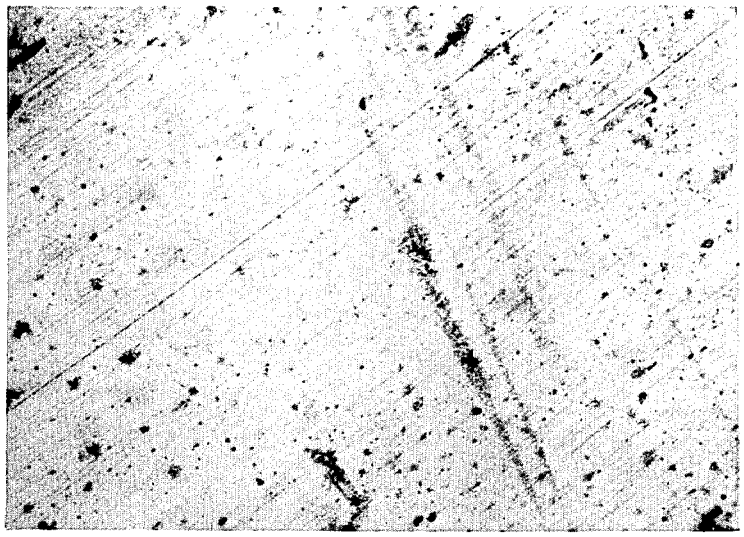
FIG. 1A shows a reproduction of a photomicrograph of a 6 -kt beta gold alloy, specifically the microstructure (100×) after a 48 hour tarnish test.
Figure 1B:
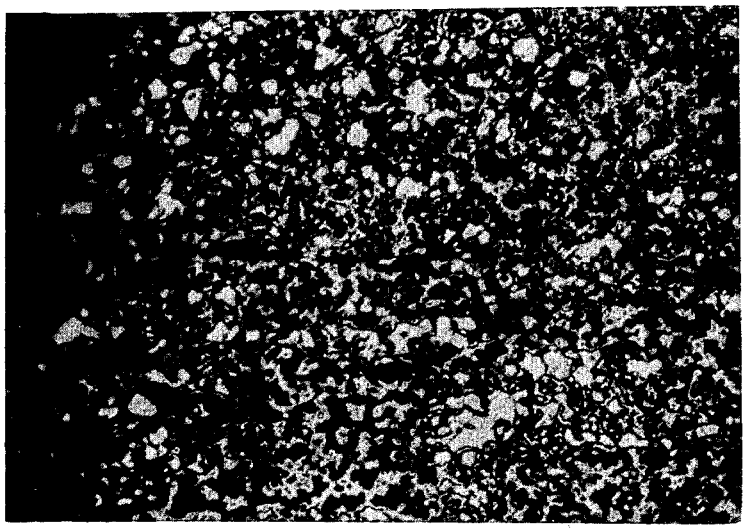
FIG. 1B shows a reproduction of a 10-kt alpha gold jewelry alloy, again the microstructure (100×) after a 48 hour tarnish test.

To test this out, eight (wedding type) 6kt beta gold rings were cast and polished and given to subjects to wear for three months. In no case was there the slightest discoloration of the finger. The subjects were told to wear the rings as they might any other ring, during working hours, and if the subject chose, to leave the ring on the finger overnight. This is not true, however, in the case of 10 kt jewelry alloy rings. Some subjects experienced a darkening of the skin on wearing these low karat jewelry alloys.

The success of the beta gold alloys of the present invention suggested extending the series to include Pd and/or Au substitution for copper, since PdZn also has a similar phase diagram with a beta phase stable at room temperature. The compositions for these last-mentioned beta noble metal alloy series can be expressed as $Au_X$-$Cu_Y$-$Pd_Z$Zn, whereas $X+Y+Z=0.5$, (or any subset of these three letters added together, e.g. X+Z, Y+Z, etc.), Weight percent compositions for these series are:

| | | | | | | | | | |
|---|---|---|---|---|---|---|---|---|---|
| | | | | Palladium series | | | | | |
| Pd | | | | | | | | | |
| 0.00 | 6.88 | 13.76 | 20.63 | 27.51 | 34.39 | 41.26 | 48.14 | 55.00 | 61.90 |
| Cu | | | | | | | | | |
| 49.50 | 45.08 | 39.51 | 33.95 | 28.38 | 22.81 | 17.24 | 10.90 | 5.53 | 00.10 |
| Zn | | | | | | | | | |
| 50.50 | 48.04 | 46.73 | 45.42 | 44.11 | 42.80 | 41.50 | 40.96 | 39.47 | 38.00 |
| All | | | | | 100.00 | | | | |
| | | | | Gold-Palladium series | | | | | |
| Au | | | | | | | | | |
| 0.00 | 5.04 | 10.09 | 15.13 | 20.18 | 25.22 | 30.27 | 35.32 | 40.36 | 45.40 |
| Pd | | | | | | | | | |
| 0.00 | 2.73 | 5.44 | 8.17 | 10.59 | 13.61 | 16.33 | 19.05 | 21.77 | 24.50 |
| Cu | | | | | | | | | |
| 49.50 | 43.86 | 38.38 | 32.89 | 27.41 | 21.93 | 16.44 | 10.96 | 5.47 | 0.10 |
| Zn | | | | | | | | | |
| 50.50 | 48.37 | 46.09 | 43.81 | 41.82 | 39.24 | 36.96 | 34.67 | 32.40 | 30.00 |
| All | | | | | 100.00 | | | | |

These series of noble metal beta alloys are readily extendible to the other face-centered cubic noble metals: Pt, Ru, Rh, Os, Ir, and Ag. That is, these noble metals can be used to replace the gold in part or in full in the beta brass alloys. It is also quite possible and feasible to use combinations of two or more of these metals as replacements in substantially the same manner and to yield substantially the same results.

The features of the present invention may be summarized by saying, that:

(a) There is a definite nobleization effect in substituting the copper atoms in beta brass with gold atoms.

(b) There is a definite nobleization enhancement in going from the alpha-type gold alloys (jewelry type) to the beta-type, kt for kt.

(c) The yellow color of the beta brass, or of the alpha type gold alloys, is maintained in the beta gold alloys, with sufficient variation to add options to the jewelry designer.

(d) The tarnish resistance characteristics of the above are maintained (but not the color) in using palladium in full or in part substitution for gold in the beta golds.

(e) This series is extendible in like manner to the other face-centered cubic noble metals: Pt, Ru, Rh, Os, Ir, and Ag which may be used singly or in combinations.

(f) Since the alloys disclosed and claimed herein are essentially casting alloys, it is considered to be one preferred procedure to incorporate a grain refiner. This is readily accomplished, for instance, by inoculating the particular alloy with an element such as Ir, Ru, or Re in the range of concentrations of 50 to 500 ppm using a copper master alloy (about 5% by wt. inoculating element). This step is currently of special importance in preparation and use of jewelry alloys.

What is claimed is:

1. A tarnish resistant beta brass body-centered cubic structure alloy comprising copper; zinc and at least about 25% by weight of a noble metal selected from the class consisting of Au and Pd.

2. A tarnish resistant beta brass body-centered cubic structure alloy comprising copper, zinc and gold wherein the gold is present to the extent of at least about 25% by weight.

3. An alloy as defined in claim 1 which further comprises at least one of the elements selected from the group consisting of Pt, Ru, Rh, Os and Ir.

* * * * *